US005489976A

United States Patent [19]

Ichikawa

[11] Patent Number: 5,489,976

[45] Date of Patent: Feb. 6, 1996

[54] TONER REPLENISHING DEVICE FOR A DEVELOPING DEVICE OF AN IMAGE FORMING APPARATUS

[75] Inventor: Hideo Ichikawa, Numazu, Japan

[73] Assignee: Ricoh Company, Ltd., Tokyo, Japan

[21] Appl. No.: 418,570

[22] Filed: Apr. 7, 1995

[30] Foreign Application Priority Data

Apr. 8, 1994 [JP] Japan ..... 6-095642

[51] Int. Cl.[6] ..... G03G 15/08

[52] U.S. Cl. ..... 355/260; 222/DIG. 1

[58] Field of Search ..... 355/200, 260; 222/DIG. 1; 366/279, 285; 403/325, 327

[56] References Cited

U.S. PATENT DOCUMENTS

| | | | |
|---|---|---|---|
| 5,307,129 | 4/1994 | Miura et al. | 355/260 |
| 5,322,198 | 6/1994 | Ichikawa . | |
| 5,325,163 | 6/1994 | Nishio | 355/260 |

FOREIGN PATENT DOCUMENTS

| | | | |
|---|---|---|---|
| 60-176448 U | 11/1985 | Japan . | |
| 61-19257 U | 2/1986 | Japan . | |
| 61-157962 U | 9/1986 | Japan . | |
| 62-16964 U | 1/1987 | Japan . | |
| 62-169357 U | 10/1987 | Japan . | |
| 4147285 | 5/1992 | Japan | 355/260 |

*Primary Examiner*—Joan H. Pendegrass
*Assistant Examiner*—Sophia Chen
*Attorney, Agent, or Firm*—Oblon, Spivak, McClelland, Maier & Neustadt

[57] ABSTRACT

A toner replenishing device for a developing device included in an image forming apparatus is disclosed. An engaging member, used to transfer a driving force from an external drive source to the shaft of an agitating member disposed in a toner container, is prevented from being damaged when, for example, the toner container is let fall by accident. The agitating member for agitating toner stored in the toner container is protected from damage when an excessive load acts on the shaft. The toner stored in the toner container is prevented from solidifying and exerting an excessive load on the shaft of the agitating member.

4 Claims, 7 Drawing Sheets

TONER REPLENISHING DEVICE FOR A DEVELOPING DEVICE OF AN IMAGE FORMING APPARATUS

BACKGROUND OF THE INVENTION

The present invention relates to a device for replenishing toner to a developing device included in a copier, facsimile apparatus, printer or similar image forming apparatus in order to develop an electrophotographic image by toner.

A conventional toner replenishing device is disclosed in, for example, Japanese Utility Model Laid-Open Publication No. 61-157962. The replenishing device includes a toner container containing fresh toner and removably mounted to an apparatus body. The toner container is formed with a slot for discharging the toner. An agitating member is disposed in the toner container and mounted on a rotary shaft in order to agitate the toner. A drive transmitting member is operatively connected to a drive source. An engaging member is also mounted on the rotary shaft and engageable with the drive transmitting member when the toner container is mounted to the apparatus body. When the toner container is mounted to the apparatus body, the engaging member is engaged with the drive transmitting member and rotated by the drive source via the drive transmitting member, thereby replenishing the toner into a developing device.

The toner replenishing device of the kind described has some problems yet to be solved, as follows. Assume that the engaging member for transferring the driving force from the drive source to the rotary shaft is affixed to the shaft at the outside of the toner container. Then, the engaging member is apt to break when, for example, the toner container is let fall by accident. Moreover, if the agitating member is rotated when the toner in the toner container is solidified, it is likely that the toner exerts an excessive load on the agitating member and breaks the shaft of the member.

In another conventional toner replenishing device, a toner container storing fresh toner is provided with a spare toner containing portion thereinside. The spare toner containing portion is mounted on a rotary shaft and feeds, while in rotation, spare toner to the container via an opening formed in the top thereof. A lug and a groove are respectively formed in the shaft and the side wall of the toner container and engaged with each other by a spring. When the lug and groove are released from each other against the action of the spring, the shaft is allowed to rotate. For this type of device, a reference may be made to Japanese Utility Model Laid-Open Publication No. 61-19257.

There has also been proposed a toner replenishing device constructed to replenish toner to a developing device while preventing it from solidifying, as taught in, for example, Japanese Utility Model Laid-Open Publication No. 60-176448. In this kind of device, toner is replenished into the developing device from a toner replenishing section. A toner containing section is communicated to the toner replenishing section in order to feed the toner. An agitating member is disposed in the toner containing section while a rotatable member is operatively connected to the agitating member by a spring. The rotatable member is connected to a drive source via an intermittent rotation mechanism.

Further, Japanese Utility Model Publication No. 53-21965, for example, discloses a toner replenishing device including a reservoir storing toner to be replenished into a developing device. A rotatable member is received in an outlet which is formed in the bottom of the reservoir. Sharp vibration is applied to the rotatable member in the axial direction of a shaft supporting the rotatable member, so that the toner in the reservoir is prevented from bridging.

SUMMARY OF THE INVENTION

It is an object of the present invention to provide a toner replenishing device capable of preventing an engaging member, used to transfer a driving force from an external drive source to the shaft of an agitating member disposed in a toner container, from being damaged when, for example, the toner container is let fall by accident.

It is another object of the present invention to provide a toner replenishing device capable of protecting the shaft of an agitating member, used to agitate toner stored in a toner container, from damage when an excessive load acts on the shaft.

It is a further object of the present invention to provide a toner replenishing device capable of preventing toner stored in a toner container from solidifying and exerting an excessive load on the shaft of an agitating member.

A device for replenishing toner to a developing device of the present invention has a toner container removably mounted to an apparatus body, including the developing device, and comprising an opening for discharging toner stored therein, and an agitating member for agitating the toner, a drive transmitting member operatively connected to a drive source, and an engaging member mounted on the rotary shaft of the agitating member and engageable, when the toner container is mounted to the apparatus body, with the drive transmitting member. The engaging member is mounted on the rotary shaft via a resilient member which constantly biases the engaging member toward an engaging position where it engages, when the toner container is mounted to the apparatus body, with the drive transmitting member in the axial direction of the rotary shaft. The engaging member is movable in the axial direction of the rotary shaft.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
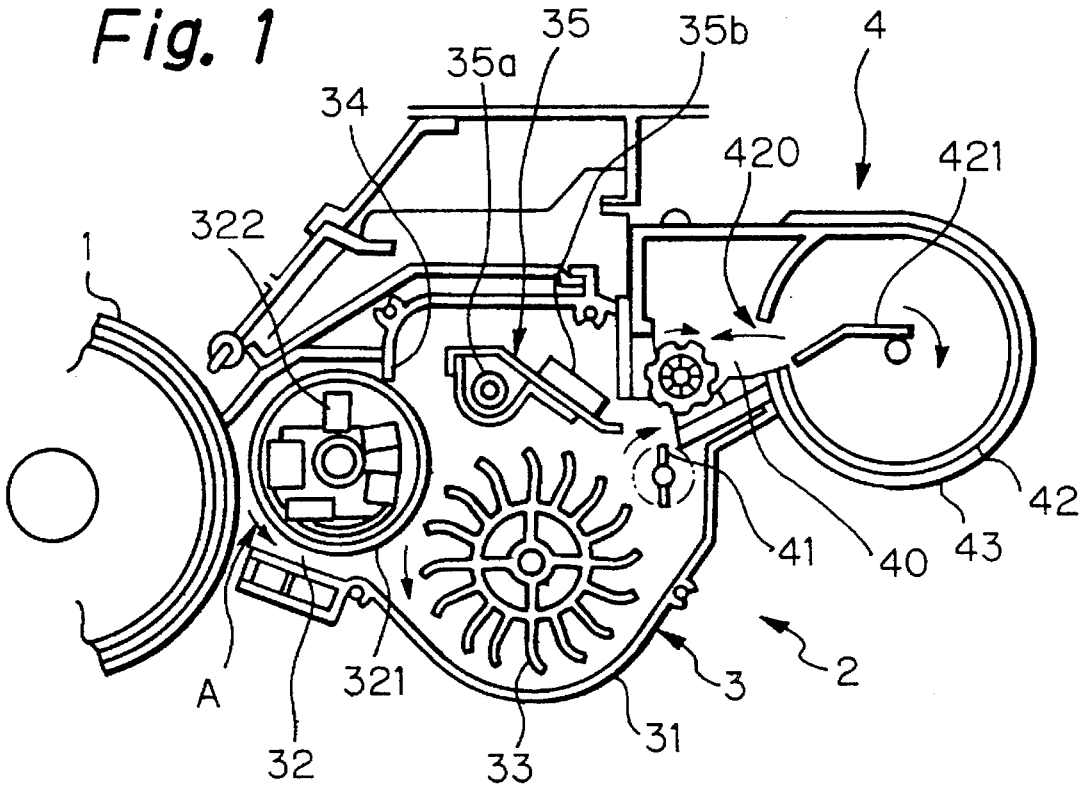
FIG. 1 is a section of a developing device including a toner replenishing device embodying the present invention.

Referring to FIG. 1 of the drawings, a toner replenishing device embodying the present invention is shown. The embodiment is applied to a developing device included in an electrophotographic copier which is a specific form of an image forming apparatus. As shown, a developing device 2 is located at the right-hand side, as viewed in the figure, of an image carrier implemented as a photoconductive drum 1. Arranged around the drum 1 are a charger, optics for exposure, image transfer and paper separation unit, cleaning unit, and discharger which are conventional electrophotographic process units, although not shown in the figure.

The developing device 2 is made up of a developing unit facing the drum 1, and a toner replenishing device 4 communicated to the developing unit 3. The developing unit 3 includes a casing 31 formed with an opening A which faces the drum 1. A developing roller 32 is disposed in the casing 31 and partly exposed to the outside through the opening A. An agitator in the form of a roller 33 supplies a developer, i.e., a toner and carrier mixture to the surface of the developing roller 32 while agitating the developer existing in the casing 31. A doctor, or developer regulating means, 34 regulates the amount of developer supplied to the developing roller 32 by the agitator 33. A separator 35 guides part of the developer removed by the doctor 34 and flowing downward. A screw 35*a* and an agitating separator 35*b* are associated with the separator 35 in order to convey the developer along the axis of the drum I while agitating it.

The toner replenishing device 4 includes a hopper 40 storing fresh toner to be replenished into the casing 31. The hopper 40 is positioned above and at the right-hand side of the casing 31 and formed with an opening which faces the interior of the casing 31. A replenishing roller 41 is positioned in the opening of the hopper 40. A toner cartridge 42 stores fresh toner to be fed to the hopper 40 and is removably supported by a holder 43. The holder 43 has a cylindrical bore slightly greater than the contour of the toner cartridge 42. The toner cartridge 42 is formed with a slot 420 for discharging the toner. An agitator 421 is disposed in the toner cartridge 42. The replenishing roller 41 and agitator 421 are rotated from the developing device side.

The developing roller 32 has a cylindrical developing sleeve 321 and a magnet roller 322 by way of example. The magnet roller, or magnetic field forming means, 322 is received in the sleeve 321 and provided with a plurality of magnetic poles.

Figure 2:
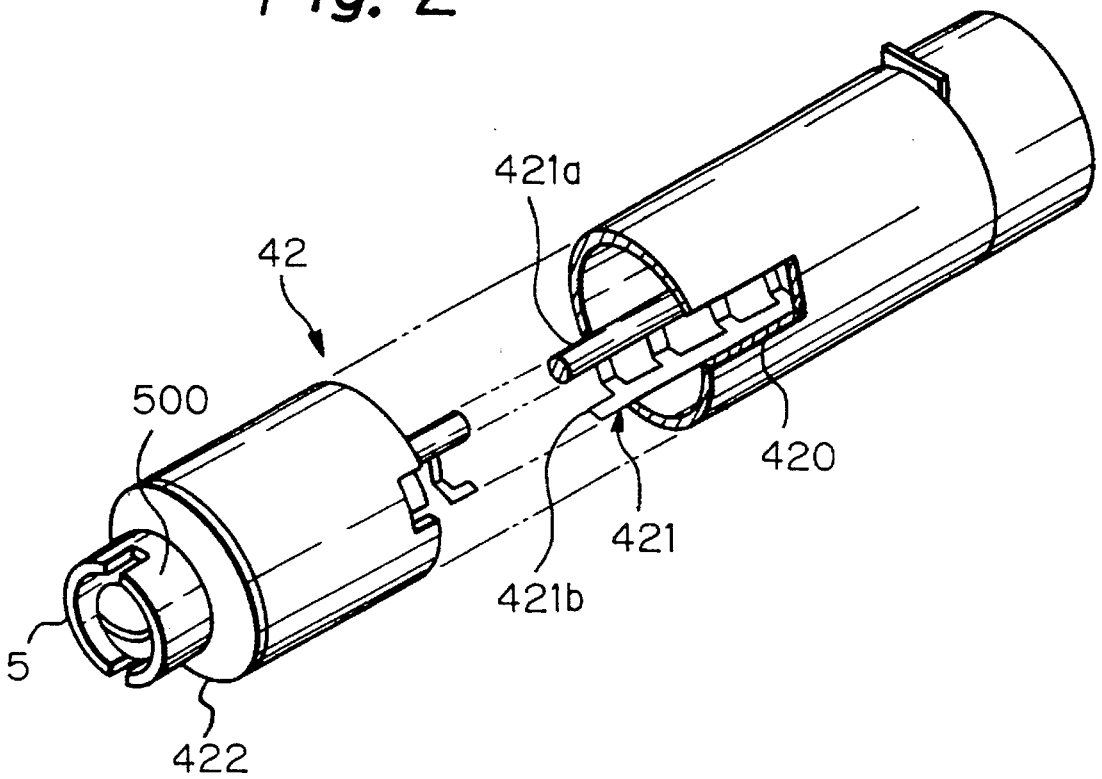
FIG. 2 is a perspective view showing a specific configuration of a toner cartridge applicable to the developing device of FIG. 1.
Figure 3:
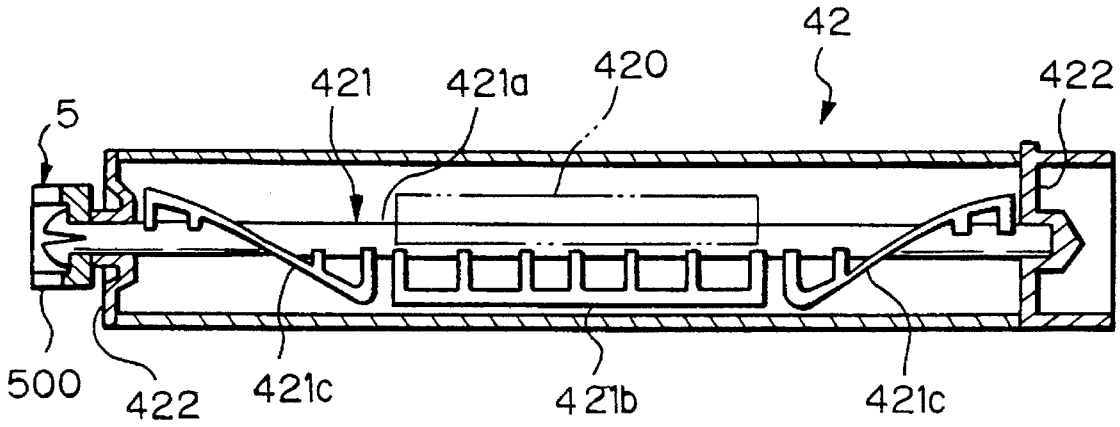
FIG. 3 is a section of the toner cartridge shown in FIG. 2.

FIGS. 2 and 3 show a specific configuration of the toner cartridge 42. As shown, the slot 420 is positioned at the intermediate between the axially opposite ends of the cartridge 42. The agitator 421 has a rotary shaft 421*a*, a rake-up plate 421*b*, and rake-out plates 421*c*. The shaft 421*a* is journalled to opposite end walls 422 of the cartridge 42. The rake-up plate 421*b* and rake-out plates 421*c* are mounted on the shaft 421*a*. Specifically, the rake-up plate 421*b* is positioned at the intermediate portion of the shaft 421*a* which faces the slot 420. The rake-out plates 421*c* are mounted on the opposite end portions of the shaft 421*a* which do not face the slot 420. Each rake-out plate 421*c* has a spiral configuration so as to convey the toner toward the slot 420 while the shaft 421*a* is in rotation. One end of the shaft 421*a* protrudes from the associated end wall 422. An engaging portion 5 is implemented as an engaging member 500 which is mounted on the protruding end of the shaft 421*a* and engageable with a drive mechanism which will be described.

Figure 4:
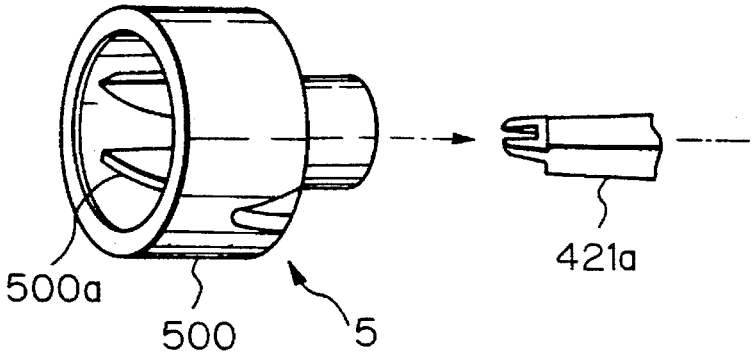
FIG. 4 is a perspective view of an engaging portion included in the toner cartridge.
Figure 5:
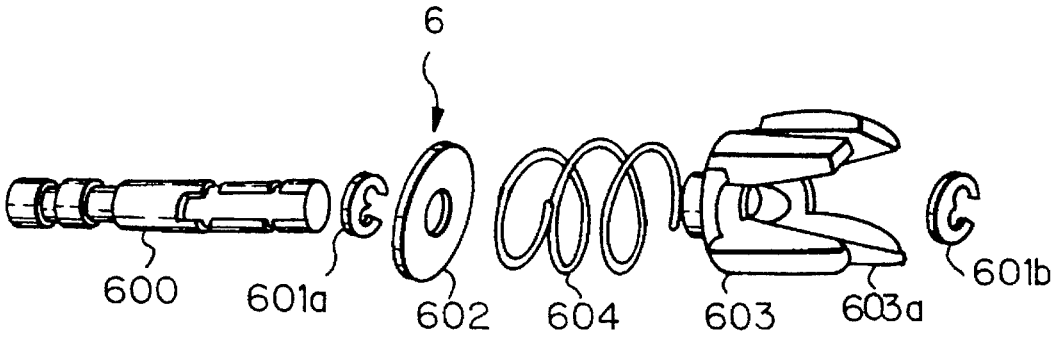
FIG. 5 is an exploded view of a drive transmitting portion engageable with the engaging portion.

Referring to FIGS. 4 and 5, the engaging portion 5 will be described together with a specific construction of a drive transmitting portion 6. As shown, the engaging member 500 is a bottomed, hollow cylindrical member whose end, opposite to the end mounted on the shaft 421*a*, is open. As shown in FIG. 4, a plurality of mating plates 500*a* are positioned on the inner circumferential surface of the engaging member 500. The engaging portion 5 transmits a driving force from a drive source, not shown, to the shaft 421*a* when engaged with the drive transmitting portion 6.

As shown in FIG. 5, the drive transmitting portion 6 includes a drive shaft 600 driven by the drive source, not shown. A disk, or spacer, 602 is formed with a hole at the center thereof through which the shaft 600 is passed. The movement of the spacer 602 to the drive source side is restricted by an E-ring 601*a*. The shaft 600 is also passed through a hole formed at the center of a pawl member 603. The movement of the pawl member 603 toward the end of the shaft 600 is also restricted by an E ring 601*b*. A coil spring 604 is loaded between the spacer 602 and the pawl member 603. The pawl member 603 is formed with pawls 603*a* capable of entering the engaging member 500 and mating with the mating plates 500*a*. The E-ring 601*b* prevents the pawl member 603 from slipping out of the shaft 600 under the action of the coil spring 603. The drive transmitting portion 6 is positioned such that when the toner cartridge 42 i s mounted to a predetermined position on the copier, the pawl member 603 enters the engaging member 500.

Figure 6A:
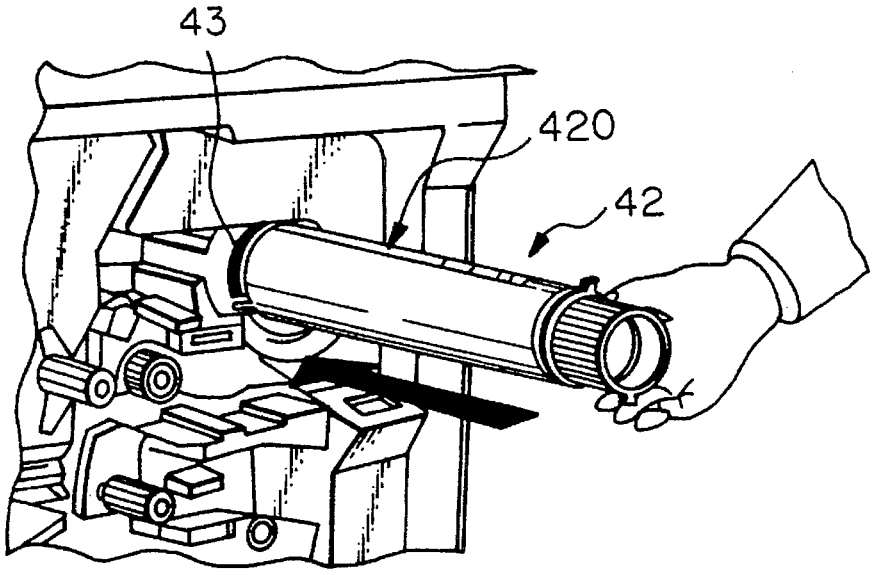
FIGS. 6A–6C demonstrate a procedure for mounting the toner cartridge to a copier.
Figure 6B:
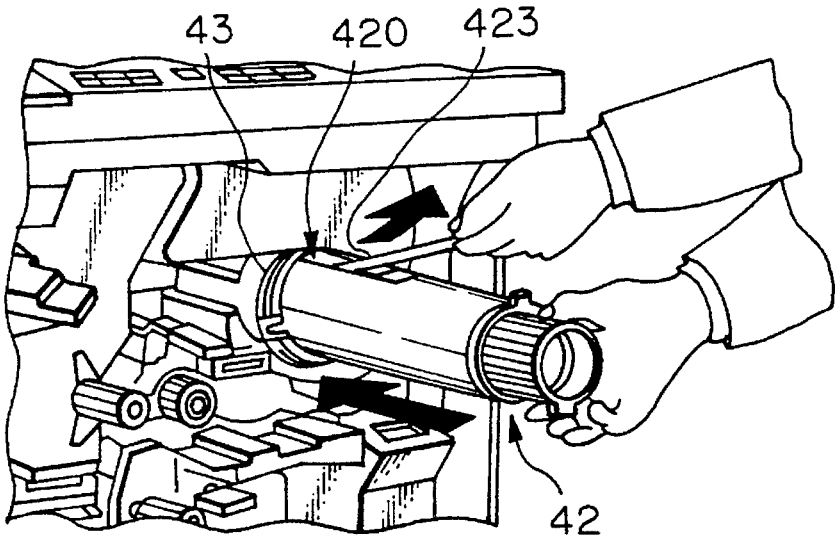
Figure 6C:
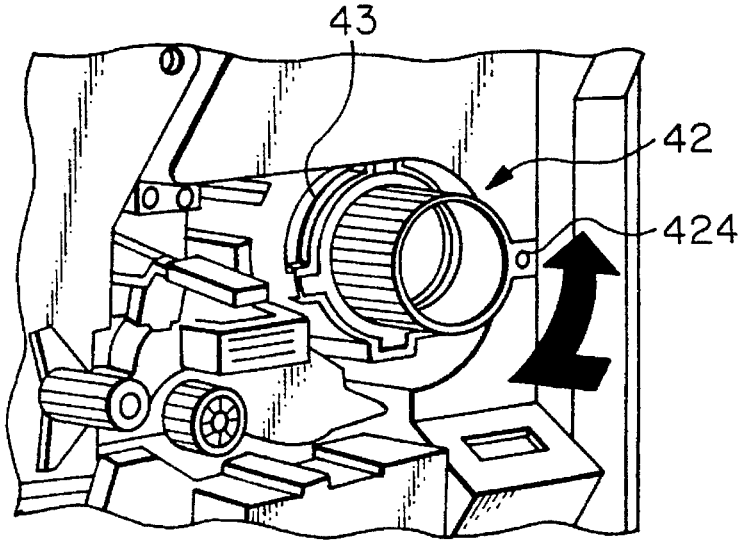

A procedure for mounting the toner cartridge 42 to the copier will be described hereinafter. First, as shown in FIG. 6A, the cartridge 42 is positioned such that the slot 420 faces upward. At this stage of procedure, the slot 420 is still closed by a seal 423. The cartridge 42 is inserted into the holder 43, FIG. 1, through an opening formed in the front end of the holder 43. Then, as shown in FIG. 6B, the toner cartridge 42 is inserted deeper into the holder 43 with the seal 423 thereof being removed. As shown in FIG. 6C, as soon as the cartridge 42 is received in the holder 43 up to the end, the cartridge 42 is rotated counterclockwise while being further pressed into the holder 43, until a mark 424 provided on the end of the cartridge 42 moves to the right.

In the above condition, the pawl member 603 enters the hollow cylindrical part of the engaging member 500. Rotation is transmitted from the drive source included in t h e developing device 2 to the shaft 600 of the drive transmitting portion 6. When the shaft 600 is rotated, the pawls 603*a* of the pawl member 603 mate with the mating plates 500*a* and cause the engaging member 500 and, therefore, the shaft 421*a* to rotate. As a result, the rake-up plate 421*b* rakes the toner upward into the slot 420. The toner is replenished into the developing unit 3 via the slot 420 and hopper 40.

When the cartridge 42 is left in, for example, an environment of room temperature, the toner stored therein is apt to solidify and decrease in fluidity. When the cartridge 42 is mounted to the copier in such a condition, the solidified toner is likely to exert on the agitator 421 a load which is greater than the torque necessary for the agitator 421 to rake tip non-solidified fluid toner. As a result, the agitator 421 fails to rake the toner upward to the slot 420. In this condition, if the driving force from the drive source is continuously transferred to the shaft 421*a*, it is likely that the shaft 421*a*, as well as the plates 421*b* and 421*c*, is broken or otherwise damaged.

Figure 7:
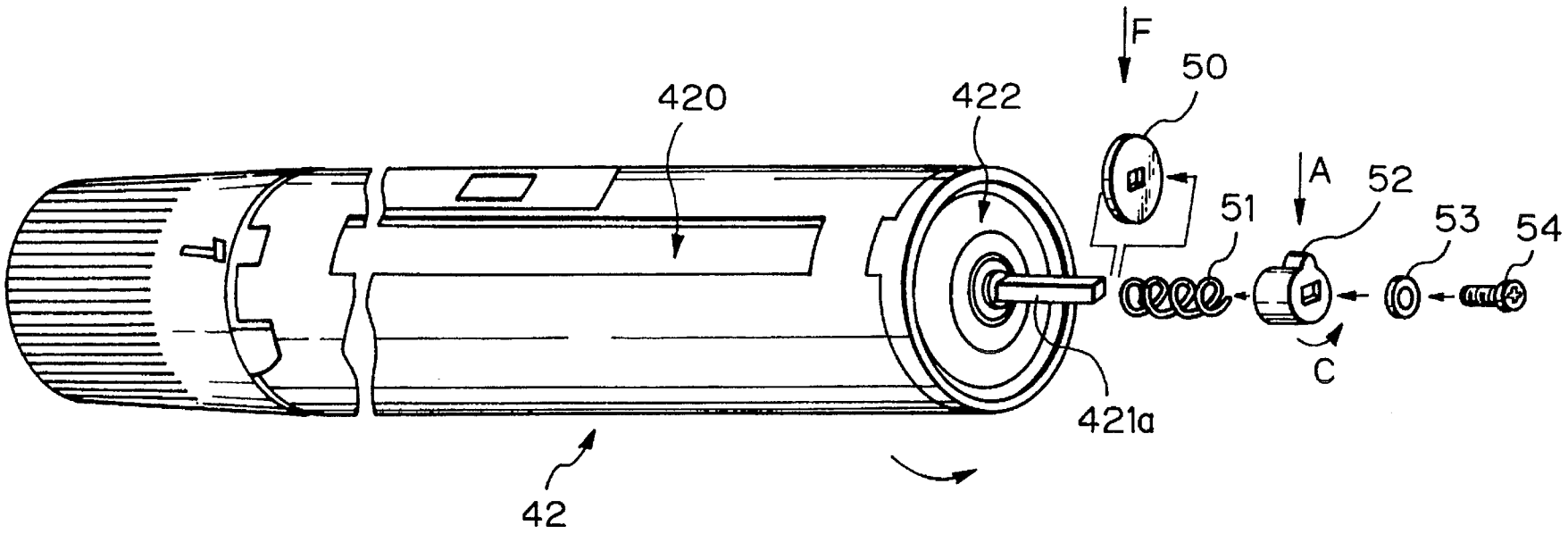
FIG. 7 is a perspective view showing another specific configuration of the toner cartridge.

In the light of this, the embodiment also proposes the arrangements of the engaging portion 5 and drive transmitting portion 6 which protect the shaft 421*a* and plates 421*b* and 421*c* of the cartridge 42 from damage, as follows. As shown in FIG. 7, the engaging portion 5 is made up of a disk-like spacer 50, a coil spring 51, a bottomed cylindrical engaging member 52, a washer 53, and a screw 54. The shaft 421*a*, protruding from the end wall 422, is passed through the spacer 50 coil spring 5 1, and engaging member 52. The washer 53 and screw 54 prevent the engaging member 52 from slipping out of the shaft 421*a* under the action of the coil spring 51. The shaft 421*a* has a square cross-section. Likewise, the holes of the spacer 50 and engaging member 52, receiving the shaft 421*a*, each has a square cross-section. In this configuration, the spacer 50 and engaging member 52 are movable in the axial direction of the shaft 421*a*, but they are prevented from rotating about the axis of the shaft 421*a*. The engaging member 52 is constantly biased toward the end of the shaft 421*a* by the coil spring 51.

Figure 8:
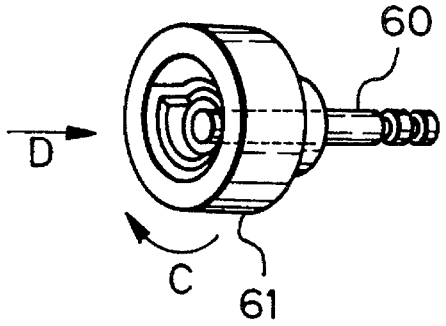
FIG. 8 is a perspective view of a drive transmitting portion engageable with an engaging member included in the toner cartridge of FIG. 7.

As shown in FIG. 8, the drive transmitting portion 6 has a drive shaft 60 connected to the drive source, not shown, and a bottomed, hollow cylindrical connecting member 61. The connecting member 61 is mounted on the end of the shaft 60 and engageable with the engaging member 52 of the engaging portion 5.

Figure 9A:
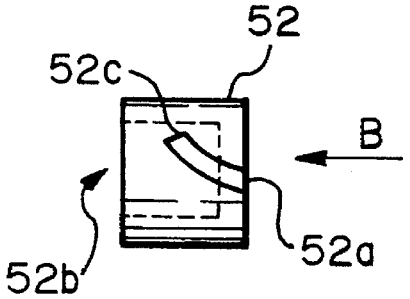
FIG. 9A is a view of the engaging member as seen in a direction A shown in FIG. 7.
Figure 9B:
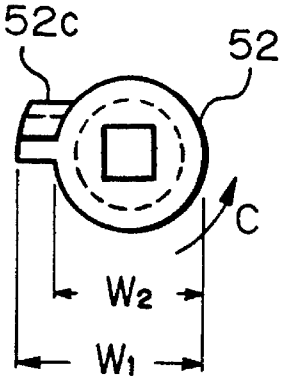
FIG. 9B is a view of the engaging member as seen in a direction B shown in FIG. 9A.

As shown in FIGS. 9A and 9B, the engaging member 52 is implemented as a bottomed, hollow cylindrical member having an end wall 52*a* and an opening 52*b*. The end wall 52*a* is formed with a square hole therethrough. The opening 52*b* is used to receive the coil spring 51 in the engaging member 52. A ridge 52*c* is formed on the outer periphery of the engaging member 52. The ridge 52*c* is inclined from the opening 52*b* toward the end wall 52*a* such that each portion thereof is positioned at the downstream side with respect to a direction of rotation C (see FIG. 9B).

Figure 10A:
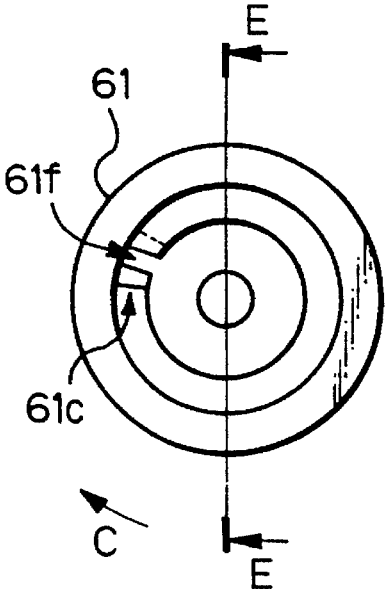
FIG. 10A is a view of a connecting member as seen in a direction D shown in FIG. 8.
Figure 10B:
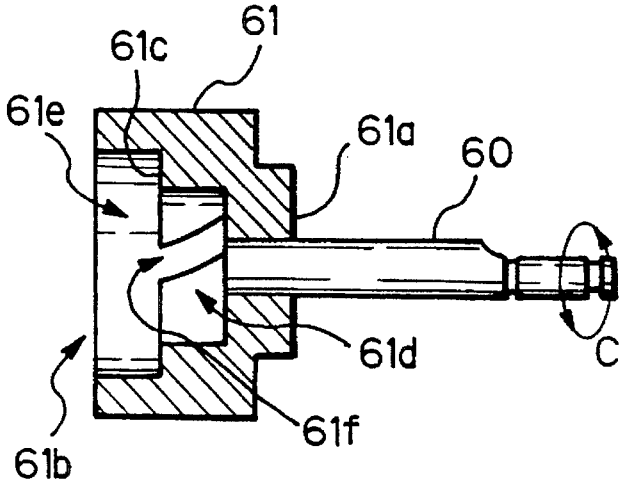
FIG. 10B is a section along line E—E and as seen in a direction indicated by arrows.

As shown in FIGS. 10A and 10B, the connecting member 61 has an end wall 61*a* on which the drive shaft 60 is mounted. The end of the connecting member 61 opposite to the end wall 61*a* is formed with an opening 61*b* for receiving the engaging member 52. The interior of the connecting member 61 is divided into a larger diameter portion 61*e* adjoining the opening 61*b*, and a smaller diameter portion 61*d* adjoining the end wall 61*a*. A shoulder 61*c* is formed between the two portions 61*d* and 61*e*. A groove 61*f* is formed in the inner periphery of the smaller diameter portion 61*d*. The groove 61*f* is inclined from the opening 61*b* toward the end wall 61*a* such that each portion thereof is positioned at the downstream side with respect to the direction of rotation C shown in FIGS. 10A and 10B. The groove 6If is capable of receiving the ridge 52*c* of the engaging member 52. The larger diameter portion 61*e* has a diameter substantially the same as (preferably slightly greater than) a dimension $W_1$ shown in FIG. 9B. The diameter of the smaller diameter portion 61*d* is substantially the same as (preferably slightly greater than) a dimension $W_2$ also shown in FIG. 9B.

When the cartridge 42 with the engaging member 52 is inserted into the copier by the procedure described with reference to FIGS. 6A–6C, the ridge 52*c* of the engaging member 52 is received in the groove 61*f* of the connecting member 61. At the same time, the engaging member 52 itself enters the smaller diameter portion 61*d* of the connecting member 61. When the connecting member 61 is rotated in the direction C, FIGS. 10A and 10B, by the drive source, it rotates the engaging member 52 and, therefore, the shaft 421*a*. As a result, the rake-up plate 421*b* drives the toner upward into the slot 420.

Assume that an excessive load acts on the agitator 421 due to, for example, the low fluidity of the toner stored in the cartridge 42. Then, before the rotation of the shaft 421*a* is fully stopped by the load, the ridge 52*c* of the engaging member 52 and the groove 61*f* of the connecting member 61 begin to slip on each other. Consequently, the engaging member 52 moves against the action of the coil spring 51 due to the rotation of the connecting member 61, so that the engaging member 52 and connecting member 61 are disengaged from each other. Hence, even when an excessive load acts on the agitator 421, the shaft 421*a*, as well as the plates 421*b* and 421*c*, is prevented from being broken or otherwise damaged.

Figure 11:
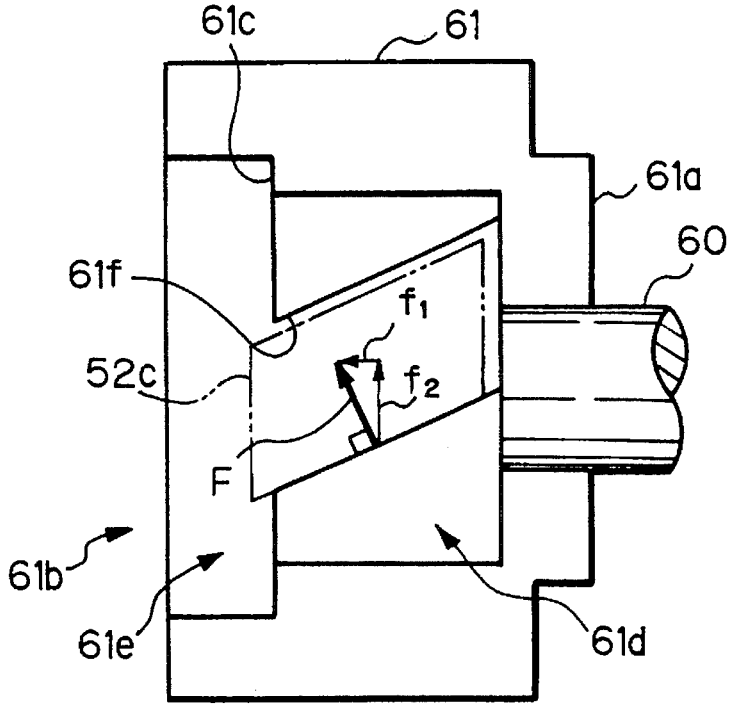
FIG. 11 shows why the engaging member and connecting member can be released from each other.

Why the engaging member 52 and connecting member 61 can be disengaged from each other is as follows. As shown in FIG. 11, the groove 61*f* presses the ridge 52*c* with a force F due to the rotation of the connecting member 61. The force F has a component $f_1$ pressing the ridge 52*c* in the axial direction, and a component $f_2$ other than the component $f_1$. The force F and, therefore, the components $f_1$ and $f_2$ each increases or decreases with an increase or a decrease in the load of the toner. When the load lies in an ordinary range in which the force of the coil spring 51 is greater than the component $f_1$, the groove 61*f* and ridge 52*c* are held in engagement. However, when the force F increases due to the load of the toner until the component $f_1$ overcomes the force of the spring 51, the component $f_1$ forces the ridge 52*c* out of the groove 61*f* while causing them to slip on each other. As a result, the groove 61*f* and ridge 52*c* are disengaged from each other.

As to conventional toner cartridges, experiments showed that the rotary shaft breaks when subjected to loads greater than 20 kg/cm$^2$. This can be obviated if the angle of the ridge 52*c* and groove 61*f* or the force of the coil spring 51 is selected such that the engaging member 52 and connecting member 61 are released from each other when a load greater than 15 kg/cm$^2$ acts on the cartridge 42.

When the cartridge 42 is mounted to the copier, it may occur that the ridge 52*c* of the engaging member 52 abuts against the shoulder 61*c* of the connecting member due to the misalignment of the ridge 52*c* and groove 61*f*. Then, the engaging member 52 will fail to mate with the connecting member 61. In such a case, because the engaging member 52 is constantly biased toward the end of the shaft 421*a* by the coil spring 51, the ridge 52*c* successfully mates with the groove 61*f* when the former is brought into alignment with the latter due to the rotation of the connecting member 61. The cartridge 42, therefore, can be easily mounted to the copier.

Furthermore, the engaging member 52 is movable in the axial direction of the shaft 421*a* while the coil spring 51 is loaded between the engaging member 52 and the spacer 50. Hence, even when the cartridge 42 is let fall by accident, the spring 51 absorbs the resulting shock and protects the engaging member 52 from damage.

In the illustrative embodiment, the cartridge 42 is so constructed as to cause the agitator 421 to vibrate every time the shaft 421*a* completes one rotation. The vibration of the agitator 421 loosens the solidified toner in the cartridge 42 or prevents the toner from solidifying. This reduces the load acting on the agitator 421 and promotes smooth replenishment of the toner to the developing unit 3.

Figure 12A:
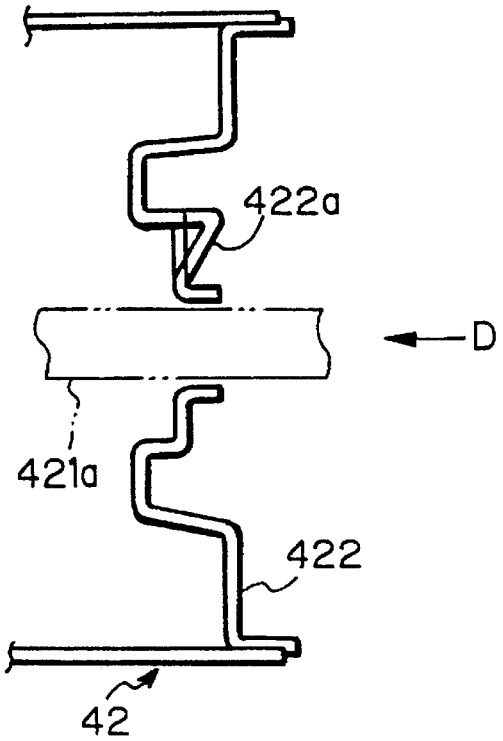
FIG. 12A is a section showing the end portion of the toner cartridge.
Figure 12B:
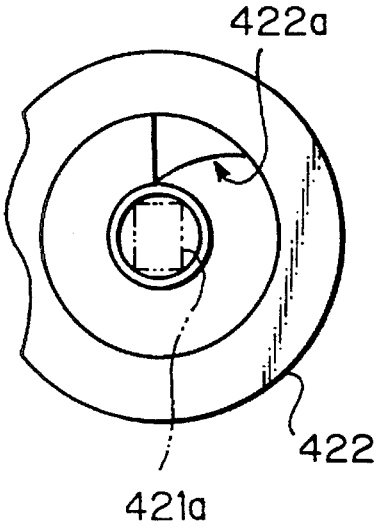
FIG. 12B is a fragmentary view of an end wall as seen in a direction D shown in FIG. 12A.
Figure 13A:
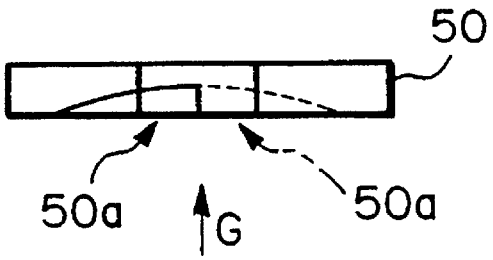
FIG. 13A shows a spacer as seen in a direction F shown in FIG. 7.
Figure 13B:
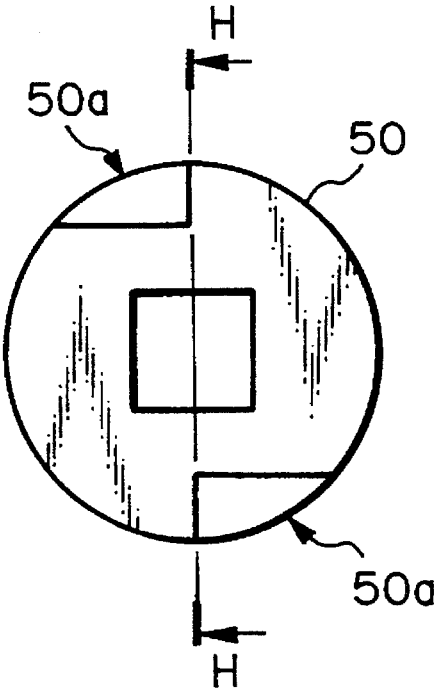
FIG. 13B shows the spacer as seen in a direction G shown in FIG. 13A.
Figure 13C:
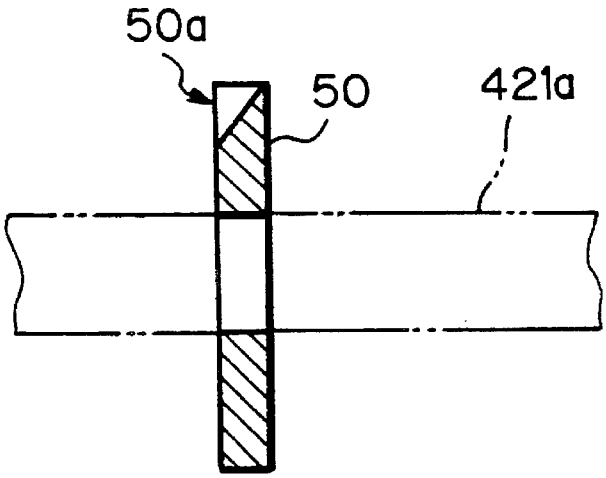
FIG. 13C is a section along line H—H of FIG. 13B and as seen in a direction indicated by arrows.

Specifically, as shown in FIGS. 12A and 12B, the end wall 422 is formed with at least one lug 422*a* in a portion thereof which faces the spacer 50. As shown in FIGS. 13A and 13B, the spacer 50 is formed with a recess 50*a* in a portion thereof which will face the lug 422*a*. Because the spacer 50 is constantly biased toward the end wall 422 by the coil spring 51, its surface having the recess 50*a* is pressed against the lug 422*a* of the end wall 422.

In the above configuration, when the shaft 421*a* is rotated, the spacer 50 mounted on the shaft 421 a rotates in contact with the lug 422*a* of the end plate 422. While the spacer 50 is in rotation, the lug 422*a* repeatedly falls in the the recess 50*a*. As a result, the agitator 421 vibrates with the rake-up plate 421*b* thereof hitting against the toner in the cartridge 42. The vibration of the agitator 421 loosens the solidified toner in the cartridge 42 or prevents the toner from solidifying. This reduces the load acting on the agitator 421 and promotes smooth replenishment of the toner to the developing unit 3, as stated above. If desired, the lug 422*a* of the end wall 422 and the recess 50*a* of the spacer 50 may be replaced with each other.

Moreover, after the ridge 52*c* and groove 61*f* have been released from each other due to an increase in the load of the toner, the ridge 52*c* jumps into the groove 61*f* due to the action of the coil spring 51 as soon as the former is brought into alignment with the latter. As a result, the ridge 52*c* causes the shaft 421*a* to vibrate. This vibration also serves to loosen the solidified toner in the cartridge 42 and thereby reduces the load acting on the agitator 421 while promoting smooth replenishment of the toner.

In the embodiment, the engaging member 52 and connecting member 61 are engageable with each other via the ridge 52*c* and groove 61*f*. Alternatively, they may be configured in such a manner as to engage at their end faces.

In summary, in accordance with the present invention, an engaging member is included in a toner container and mounted on the rotary shaft of an agitating member via a resilient member. This, coupled with the fact that the engaging member is movable in the axial direction of the shaft, successfully absorbs a shock when, for example, the toner container is let fall by accident, thereby protecting the engaging member from damage.

When a force greater than the force of the resilient member acts on the engaging member in a direction opposite to the biasing direction of the resilient member, the engaging member is released from a drive transmitting member. Hence, an excessive load which would break or otherwise damage the shaft is preventing from continuously acting on the shaft.

Even after the engaging member has been disengaged from the drive transmitting member, the former is brought into engagement with the latter as soon as they meet each other. This is because the engaging member is moved by the resilient member to a position where it meets the drive transmitting member. When the engaging member and drive transmitting member mate with each other, vibration acts on the shaft. The vibration loosens toner solidified in the toner container, reduces the load acting on the shaft, and promotes smooth replenishment of the toner to a developing unit.

Further, assume that the engaging member and an engaging portion included in the drive transmitting member are misaligned in the circumferential direction of the s h aft when the toner container is mounted to a copier. Then, they are automatically brought into engagement by the rotation of the drive transmitting member. This allows the toner container to be easily mounted to the copier.

In addition, because the shaft is caused to vibrate every time it completes one rotation, it loosens the solidified toner in the toner container or prevents the toner from solidifying. As a result, the load acting on the shaft is reduced, and smooth replenishment of toner to the developing unit is promoted.

Various modifications will become possible for those skilled in the art after receiving the teachings of the present disclosure without departing from the scope thereof.

What is claimed is:

1. A device for replenishing toner to a developing device, comprising:

a toner container removably mounted to an apparatus body, including said developing device, and comprising an opening for discharging toner stored therein, and an agitating member for agitating said toner;

a drive transmitting member operatively connected to a drive source; and an engaging member mounted on a rotary shaft of said agitating member and engageable, when said toner container is mounted to said apparatus body, with said drive transmitting member;

said engaging member being mounted on said rotary shaft via a resilient member which constantly biases said engaging member toward an engaging position where said engaging member engages, when said toner container is mounted to said apparatus body, with said drive transmitting member in an axial direction of said rotary shaft, said engaging member being movable in said axial direction of said rotary shaft.

2. A device as claimed in claim 1, wherein said engaging member and an engaging portion included in said drive transmitting member engage with each other at respective inclined surfaces, said engaging member moving, when a force greater than a bias of said resilient member acts on said engaging member engaged with said drive transmitting member in a direction opposite to a biasing direction of said resilient member, in said direction to be thereby disengaged from said drive transmitting member.

3. A device as claimed in claim 2, wherein when said drive transmitting member disengaged from said engaging member is rotated until said engaging member and said engaging portion of said drive transmitting member align with each other in a circumferential direction of said rotary shaft, said engaging member is caused to move toward said engaging position by said resilient member and engaged with said drive transmitting member.

4. A device as claimed in claim 1, further comprising a rotatable member mounted on said rotary shaft and facing an end wall of said toner container, one of said end wall and an end of said rotatable member facing said end wall being formed with a lug while the other being formed with a recess, said lug and said recess intermittently engaging with each other while said rotatable member is in rotation.

* * * * *